US009157716B1

(12) United States Patent
Ginetto et al.

(10) Patent No.: US 9,157,716 B1
(45) Date of Patent: Oct. 13, 2015

(54) SHOT START RING FOR PROJECTILE

(71) Applicants: Stephen Ginetto, Carlstadt, NJ (US); Andrew Moramarco, Staten Island, NY (US); Leanne Mohla, Blairstown, NJ (US)

(72) Inventors: Stephen Ginetto, Carlstadt, NJ (US); Andrew Moramarco, Staten Island, NY (US); Leanne Mohla, Blairstown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/499,471

(22) Filed: Sep. 29, 2014

(51) Int. Cl.
*F42B 14/06* (2006.01)
*F42B 14/02* (2006.01)
*F41A 21/18* (2006.01)

(52) U.S. Cl.
CPC ..... *F42B 14/067* (2013.01); *F41A 21/18* (2013.01); *F42B 14/02* (2013.01)

(58) Field of Classification Search
CPC ..... F42B 14/02
USPC ..... 102/520–528; 86/52; 42/77
See application file for complete search history.

(56) References Cited

U.S. PATENT DOCUMENTS

| | | | | | |
|---|---|---|---|---|---|
| 2,638,051 | A * | 5/1953 | Critchfield | ..... | 102/522 |
| 2,992,612 | A * | 7/1961 | Critchfield et al. | ..... | 102/522 |
| 3,613,596 | A * | 10/1971 | Walde | ..... | 102/525 |
| 4,140,061 | A * | 2/1979 | Campoli | ..... | 102/529 |
| 4,385,561 | A * | 5/1983 | Madderra | ..... | 102/523 |
| 4,939,997 | A * | 7/1990 | Hoffman | ..... | 102/503 |
| 6,776,102 | B2 * | 8/2004 | Thiesen et al. | ..... | 102/527 |
| 2014/0076191 | A1 * | 3/2014 | Abeln et al. | ..... | 102/526 |

* cited by examiner

*Primary Examiner* — Reginald Tillman, Jr.
(74) *Attorney, Agent, or Firm* — Michael C. Sachs

(57) ABSTRACT

A shot start ring for obtaining consistent chamber pressure in a gun tube includes an annular ring having a central longitudinal axis, an axial width and a circumferential gap defined by two opposing ends of the ring. The ring includes first and second opposing faces lying in respective planes that are perpendicular to the central longitudinal axis. One of the faces has a groove formed therein that extends around a complete circumference of the ring. A plurality of notches are formed in a radially inner surface of the ring. After the desired chamber pressure is reached, the ring fails at the circumferential groove and the notches.

18 Claims, 4 Drawing Sheets

SHOT START RING FOR PROJECTILE

STATEMENT OF GOVERNMENT INTEREST

The inventions described herein may be manufactured, used and licensed by or for the United States Government.

BACKGROUND OF THE INVENTION

The invention relates in general to gun-launched projectiles and in particular to apparatus and methods for obtaining consistent gun chamber pressure for gun-launched projectiles.

It is known that the chamber pressure in a gun directly affects the velocity of a projectile. An accurate and consistent velocity requires an accurate and consistent chamber pressure. Some known methods for obtaining consistent chamber pressures include shot start rods and crimping.

A shot start rod connects the cartridge case to the projectile with grooves that are designed to break at a desired pressure. The shot start rod is secured lengthwise between the cartridge case and the projectile with a necked down section in the rod body. When the cartridge is ignited, the necked down section of the rod will fail at a desired chamber pressure. Until the desired pressure is reached, the rod holds the projectile in place in the gun tube. After the desired chamber pressure is reached, the rod will break and the projectile will follow a normal interior projectile travel. A shot start rod adds weight to a weapon and decreases the size of the usable space in a weapon's chamber.

Crimping is common in larger ammunition and works by bending or crimping the outside shell of a cartridge case to the grooves on the projectile. Crimping has been used in 105 mm rounds. As with the shot start rod, the crimp holds the projectile in place until the desired chamber pressure is reached. At that point, the crimp fails and the projectile is released. The chamber pressures achieved with crimping can be inconsistent and difficult to quantify.

The lethality of a projectile is directly related to its velocity and its velocity is directly related to the gun chamber pressure. A need exists for an apparatus and method for obtaining accurate and consistent chamber pressure in a gun tube.

SUMMARY OF INVENTION

One aspect of the invention is a shot start ring for use with a projectile in a gun tube. The shot start ring includes an annular ring having a central longitudinal axis, an axial width and a circumferential gap defined by two opposing ends of the ring. The ring includes first and second opposing faces lying in respective planes that are perpendicular to the central longitudinal axis. One of the faces has a groove formed therein. The groove extends around a complete circumference of the ring from one opposing end to the other opposing end. A plurality of notches are formed in a radially inner surface of the ring. Each notch extends completely across the axial width of the ring and radially inward to the groove.

The plurality of notches may be circumferentially equally spaced around the ring.

A locating tab formed as a protrusion may extend radially inward from the inner surface of the ring.

Another aspect of the invention is an apparatus including a novel shot start ring and a sabot. The sabot may have a plurality of circumferential sections. Each section of the sabot includes a groove for the shot start ring. The apparatus may include a projectile. The sabot is disposed on an exterior surface of the projectile.

The apparatus may also include a gun tube having a groove extending completely around an interior circumference of the gun tube and lying in a plane normal to a longitudinal axis of the gun tube. The shot start ring may be partially disposed in the groove in the gun tube.

In another aspect, the invention includes a method of obtaining consistent chamber pressure in a gun. The method includes providing a gun tube having a groove extending completely around an interior circumference of the gun tube and lying in a plane normal to a longitudinal axis of the gun tube. Further provided is a projectile and a sabot disposed around the projectile. The sabot includes a second groove extending completely around a circumference of the sabot. Additionally provided is a shot start ring. The shot start ring is placed in the second groove in the sabot. The projectile, sabot and shot start ring are placed in the gun tube with the shot start ring being disposed partially in the groove in the gun tube and partially in the second groove in the sabot.

The method may include igniting propellant behind the projectile and then shearing the shot start ring along a third groove extending around a complete circumference of the shot start ring.

The method may include breaking the shot start ring into a plurality of pieces at notches formed in an inner surface of the ring.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
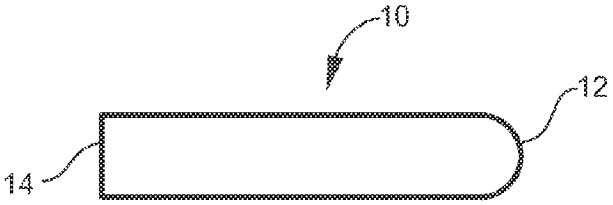
FIG. 1 PRIOR ART
FIG. 1 is a schematic of a gun-launched projectile.
Figure 2A:
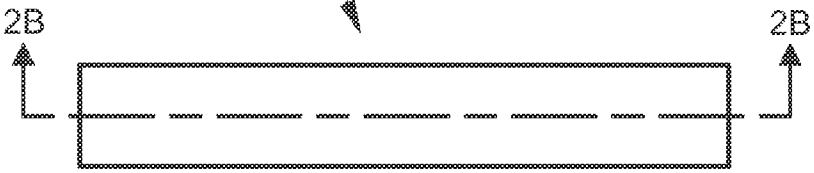
FIG. 2A is a schematic of a gun tube.
Figure 3A:
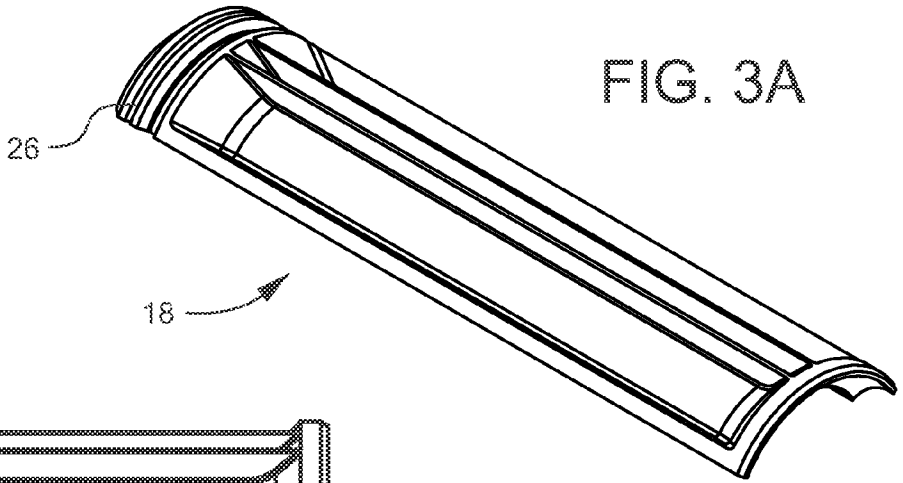
FIGS. 3A, 3B and 3C are perspective, side and bottom views, respectively, of one embodiment of a circumferential section of a sabot.
Figure 3B:
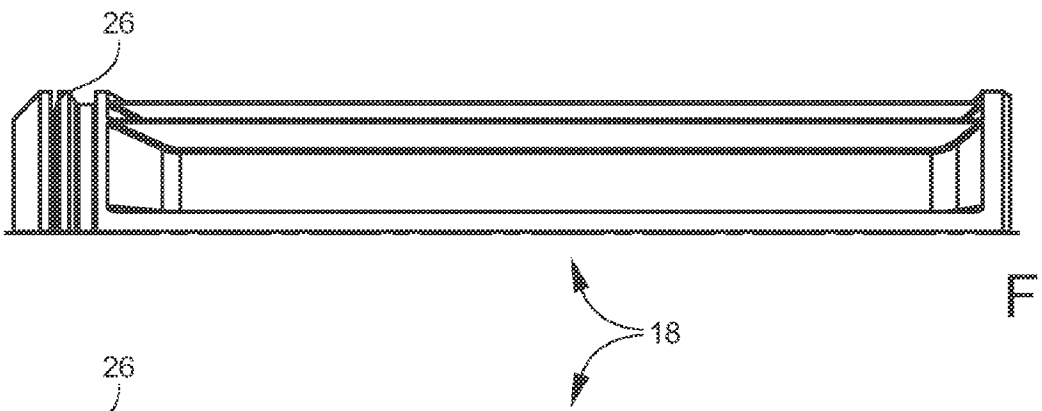
Figure 3C:
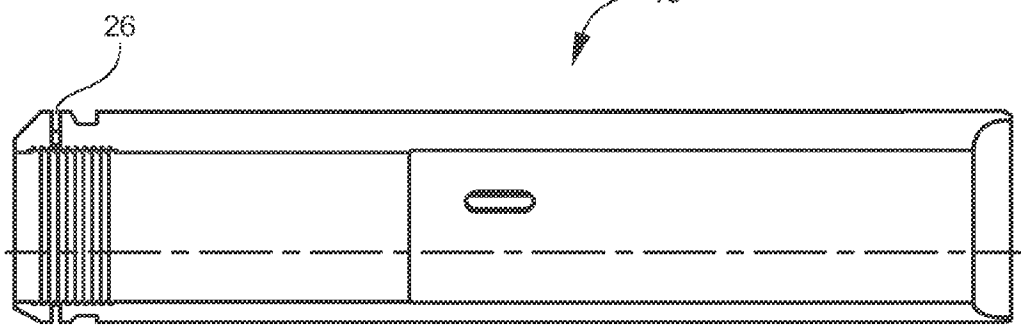
Figure 5:
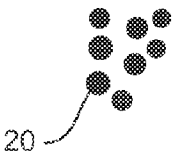
FIG. 5 PRIOR ART
FIG. 5 is a schematic of gun propellant.

FIG. 1 is a schematic of a gun-launched projectile 10 having a nose end 12 and a rear end 14. Projectile 10 may be launched from a gun tube, such as gun tube 16 of FIG. 2A. In some cases, the caliber of projectile 10 may be less than the caliber of gun tube 16. In those cases, a sabot may be disposed around projectile 10. The sabot may have multiple circumferential sections, such as sabot circumferential section 18 (FIGS. 3A, 3B and 3C). Each section 18 extends 120 degrees circumferentially. Thus, three sections 18 are required for a complete sabot for projectile 10. Projectile 10 with sabot sections 18 may be launched from gun tube 16 using propellant 20 (FIG. 5).

An apparatus and method to provide a consistent chamber pressure in gun tube 16 includes a shot start ring 22 (FIGS. 4A-G). Prior to launch of projectile 10, a portion of shot start ring 22 is disposed in a groove formed in sabot sections 18 and a portion of ring 22 is disposed in a groove formed in the interior of gun tube 16. At a predetermined pressure, ring 22 fails or breaks and releases sabot sections 18 and projectile 10. Ring 22 may be made of, for example, steel.

Figure 2B:
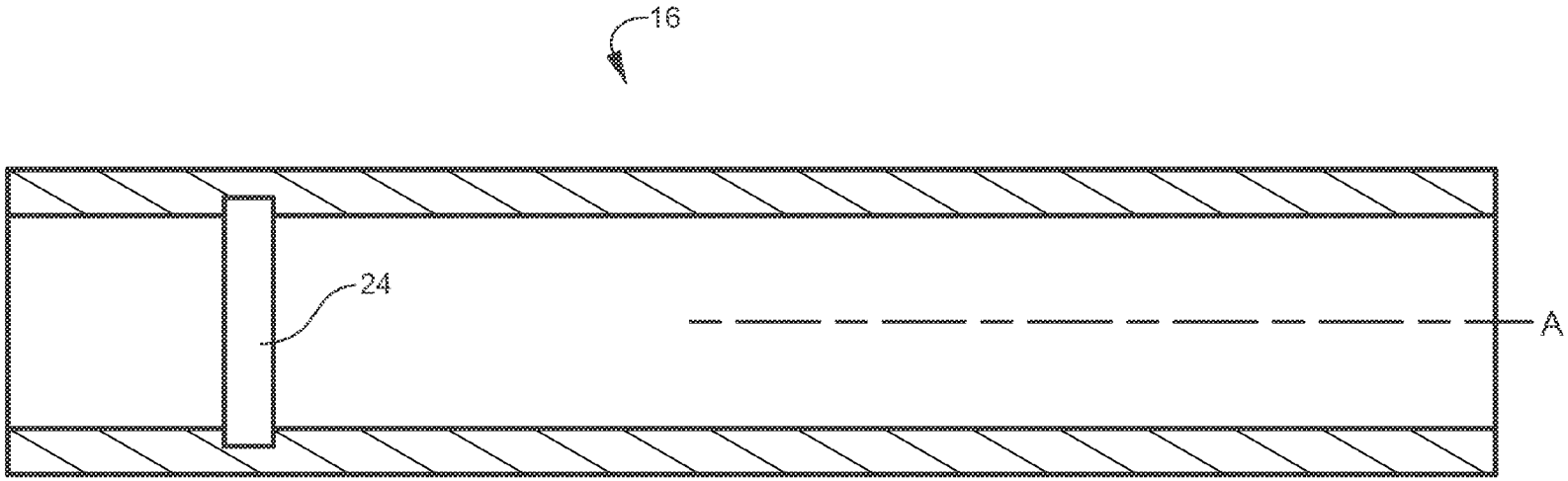
FIG. 2B is a sectional view taken along the line 2B-2B of FIG. 2A.

FIG. 2B shows a groove 24 formed in the interior of gun tube 16. Groove 24 extends completely around the interior circumference of gun tube 16. Groove 24 lies in a plane that is normal to the longitudinal axis A of gun tube 16. Prior to launch of projectile 10, a radially outer portion of ring 22 is disposed in groove 24.

FIGS. 3A-C show a groove 26 formed in the rear portion of sabot sections 18. Prior to launch of projectile 10, a radially inner portion of ring 22 is disposed in groove 26.

Figure 4A:
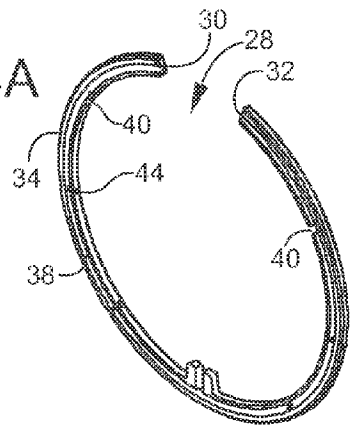
FIG. 4A is a perspective view of one embodiment of a shot start ring.
Figure 4F:
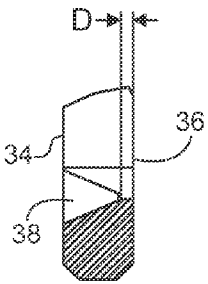
FIG. 4F is an enlarged view of a portion of FIG. 4D.
Figure 4D:
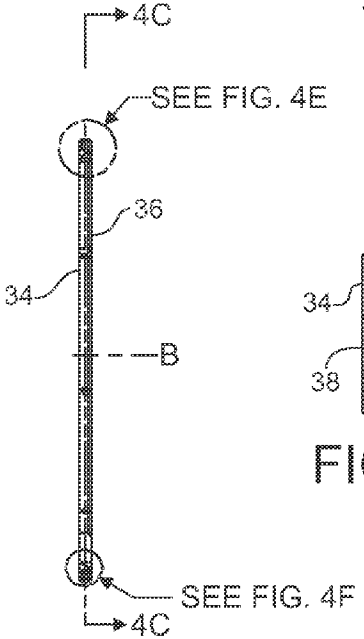
FIG. 4D is a sectional view taken along the line 4D-4D of FIG. 4C.
Figure 4G:
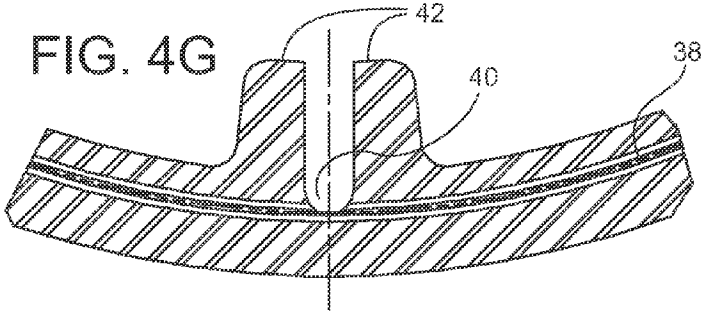
FIG. 4G is an enlarged view of a portion of FIG. 4C.
Figure 4E:
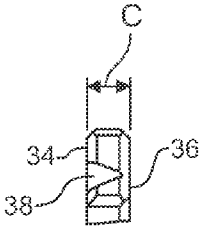
FIG. 4E is an enlarged view of a portion of FIG. 4D.
Figure 4C:
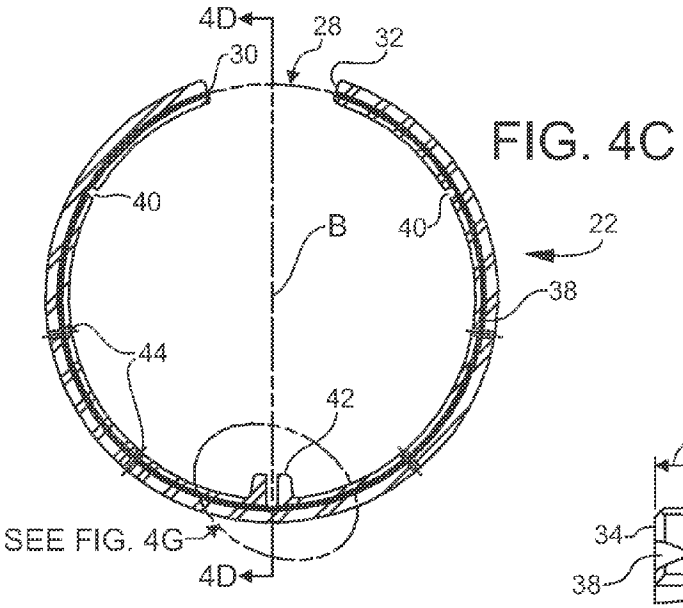
FIG. 4C is a sectional view taken along the line 4C-4C of FIG. 4D.
Figure 4B:
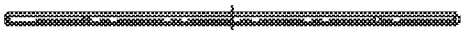
FIG. 4B is an elevation view of the ring of FIG. 4A.

Referring to FIGS. 4A-G, shot start ring 22 is an annular ring having a central longitudinal axis B and an axial width C (FIG. 4E). Ring 22 does not form a complete circle. Ring 22 includes a circumferential gap 28 defined by two opposing ends 30, 32. Ring 22 includes first and second opposing faces 34, 36 lying in respective planes that are perpendicular to the central longitudinal axis B of ring 22.

Face 34 has a groove 38 formed therein. Groove 38 may be generally V-shaped. Groove 38 extends around the complete circumference of the ring 22 from one opposing end 30 to the other opposing end 32. A plurality of notches 40 are formed in the radially inner surface of the ring 22. Each notch 40 extends completely across the axial width C of the ring 22 and radially inward to the groove 38.

Notches 40 maybe circumferentially equally spaced around the ring 22. Notches 40 are spaced to correspond to the abutting edges of sabot sections 18. Thus, the number of notches 40 equals the number of sabot sections 18. In the embodiment shown in the Figs., the number of notches 40 and sabot sections 18 is three, but other numbers may be used. To properly locate notches 40 on ring 22 with respect to the abutting edges of sabot sections 18, a locating tab 42 may be provided on ring 22. Locating tab 42 may include one or more protrusions that extend from the radially inner surface of the ring 22. The locating tab 42 may be disposed in a mating opening (not shown) in a sabot section 18. Alternatively, openings 44 may be formed in ring 22 for receiving locating pins (not shown) that penetrate into sabot sections 18.

Referring to FIG. 4F, the area of minimum thickness of ring 22 at the base of groove 38 has an axial width D. Dimension D may be varied to alter the predetermined pressure at which ring 22 will fail and projectile 10 will be launched. Varying dimension D varies the depth of groove 38.

Figure 6:
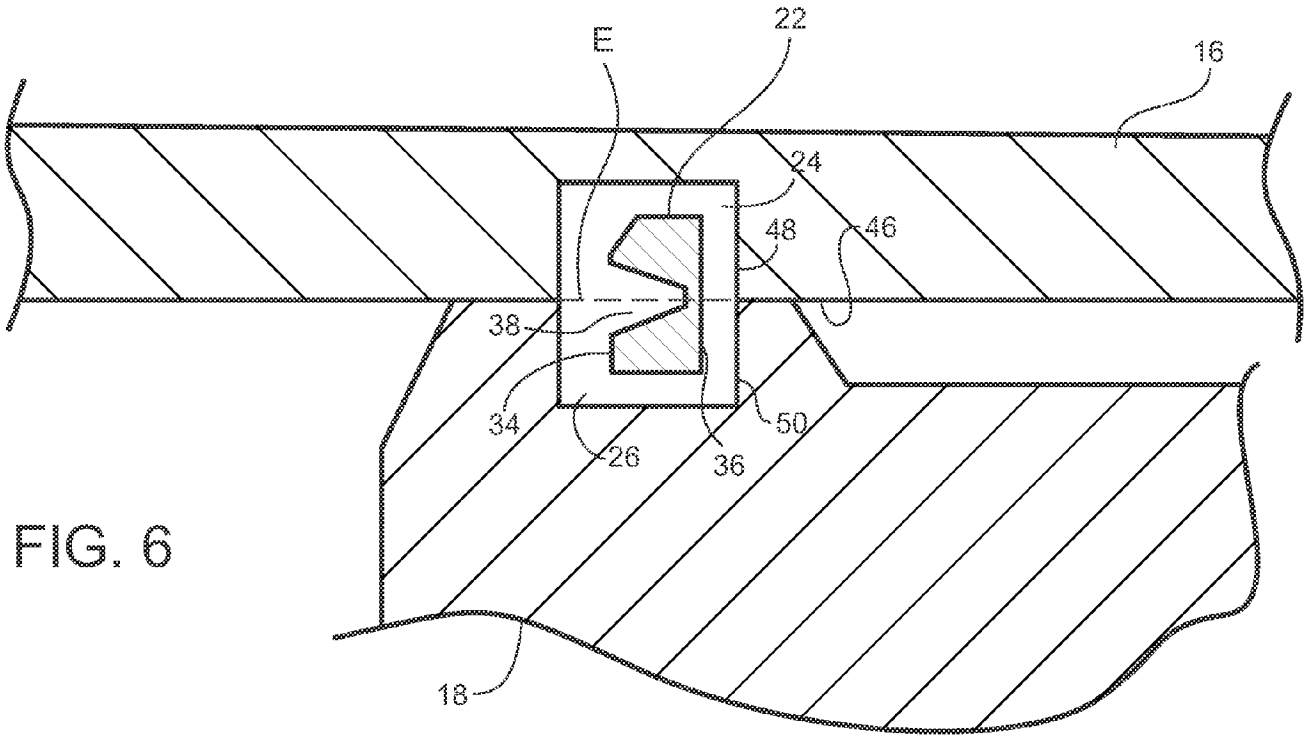
FIG. 6 is a partial longitudinal sectional view showing a shot start ring disposed in a groove in a gun tube and a groove in a sabot.

FIG. 6 is a partial longitudinal sectional view showing shot start ring 22 disposed in groove 24 in gun tube 16 and groove 26 in sabot sections 18. Prior to igniting the propellant 20 in gun tube 16, the shot start ring 22 is situated so that a radially outer portion of the ring 22 is disposed in groove 24 and a radially inner portion of the ring 22 is disposed in groove 26, as shown in FIG. 6. Preferably, the ring 22 is positioned so that a bisecting line E (shown as a dashed line in FIG. 6) of groove 38 is collinear with the inner surface 46 of gun tube 16. The inner surface 46 defines the caliber of gun tube 16. The position of ring 22 could also be reversed 180 degrees from the position shown in FIG. 6. That is, face 34 of ring 22 may face in either the forward or rear direction in gun tube 16.

When the propellant 20 is ignited, pressure increases in gun tube 16. At a predetermined pressure, ring 22 will fail at groove 38 as ring 22 is pressed against the forward wall 48 of gun tube groove 24 and the forward wall 50 of sabot groove 26. After failure of ring 22, the radially outer portion of the ring 22 disposed in the gun tube groove 24 will remain in the gun tube groove 24. The radially inner portion of the ring 22 disposed in the sabot groove 26 will remain in the sabot groove 26 and travel with the projectile 10.

In addition to failing circumferentially at groove 38. ring 22 will also fail at the notches 40 so that the portion of the ring 22 that remains in the sabot grooves 26 will be in a plurality of pieces. The plurality of pieces of ring 22 enable the sabot sections 18 to separate from the projectile 10 after exiting the muzzle of the gun tube 16, without being constrained by the remaining portion of the ring 22. In the embodiment shown in the Figs, the number of notches 40 is three so the radially inner portion of the ring 22 will separate into four pieces. The presence of gap 28 results in four pieces, rather than three.

During testing, the shot start ring 22 held the projectile 10 in place until the desired chamber pressure was reached. The ring 22 then failed and the projectile 10 exited the muzzle. In the first five to ten meters after muzzle exit, the sabot sections 18 discarded from the projectile 10, providing verification that the ring 22 had also failed at the notches 40.

While the invention has been described with reference to certain embodiments, numerous changes, alterations and modifications to the described embodiments are possible without departing from the spirit and scope of the invention as defined in the appended claims, and equivalents thereof.

What is claimed is:

1. A shot start ring for use with a projectile in a gun tube, comprising:

an annular ring having a central longitudinal axis, an axial width and a circumferential gap defined by two opposing ends of the ring;

the ring including first and second opposing faces lying in respective planes that are perpendicular to the central longitudinal axis;

one of the faces having a groove formed therein, the groove extending around a complete circumference of the ring from one opposing end to the other opposing end; and a plurality of notches formed in a radially inner surface of the ring, each notch extending completely across the axial width of the ring and radially inward to the groove.

2. The ring of claim 1, wherein the plurality of notches are circumferentially equally spaced around the ring.

3. The ring of claim 2, wherein a number of notches is three.

4. The ring of claim 2, wherein the ring is made of steel.

5. The ring of claim 2, the groove is generally V-shaped.

6. The ring of claim 2, further comprising a locating tab formed as a protrusion that extends radially inward from the inner surface of the ring.

7. An apparatus, comprising:

the shot start ring of claim 1; and a sabot having a plurality of circumferential sections, each section including a second groove wherein the shot start ring is partially disposed in the second grooves.

8. The apparatus of claim 7, wherein a number of circumferential sections is three.

9. The apparatus of claim 7, further comprising the projectile with the sabot disposed on an exterior surface of the projectile.

10. The apparatus of claim 9, further comprising the gun tube, the gun tube having a third groove extending completely around an interior circumference of the gun tube and lying in a plane normal to a longitudinal axis of the gun tube wherein the shot start ring is partially disposed in the third groove.

11. The apparatus of claim 10, wherein an entire circumferential extent of the groove of the shot start ring is partially disposed in the third groove.

12. The apparatus of claim 11, wherein about one half of a radial thickness of the groove is disposed in the third groove.

13. A method of obtaining consistent chamber pressure in a gun, comprising:

providing a gun tube having a groove extending completely around an interior circumference of the gun tube and lying in a plane normal to a longitudinal axis of the gun tube;

providing a projectile and a sabot disposed around the projectile, the sabot including a second groove extending completely around a circumference of the sabot;

providing a shot start ring and placing the shot start ring in the second groove in the sabot; and placing the projectile, sabot and shot start ring in the gun tube with the shot start ring being disposed partially in the groove in the gun tube and partially in the second groove in the sabot; and further comprising igniting propellant behind the projectile and then shearing the shot start ring along a third groove extending around a complete circumference of the shot start ring.

14. The method of claim 13, further comprising breaking the shot start ring into a plurality of pieces at notches formed in an inner surface of the ring.

15. An apparatus, comprising:

a gun tube having a groove extending completely around an interior circumference of the gun tube and lying in a plane normal to a longitudinal axis of the gun tube;

a projectile with a sabot disposed in the gun tube, the sabot having a plurality of circumferential sections and a second groove formed around a circumference of the sabot; and a shot start ring having a central longitudinal axis, an axial width and a circumferential gap defined by two opposing ends of the ring;

wherein the shot start ring is partially disposed in the groove of the gun tube and partially disposed in the second groove in the sabot; and wherein the shot start ring includes first and second opposing faces lying in respective planes that are perpendicular to the central longitudinal axis, one of the faces having a third groove formed therein, the third groove extending around a complete circumference of the ring from one opposing end to the other opposing end.

16. The apparatus of claim 15, wherein the shot start ring includes a plurality of notches formed in an inner surface of the ring, each notch extending completely across the axial width of the ring and radially inward to the third groove.

17. The apparatus of claim 16, wherein the plurality of notches are circumferentially equally spaced around the ring.

18. The apparatus of claim 16, wherein the third groove is generally V-shaped.

* * * * *